US005896998A

United States Patent [19]

Bjorklund et al.

[11] Patent Number: 5,896,998

[45] Date of Patent: Apr. 27, 1999

[54] VIBRATORY SCREENING APPARATUS

[75] Inventors: Ola Bjorklund, Älvsjö , Sweden; Alexander F. Ritchie, Kincardineshire; George L. Souter, Aberdeen, both of United Kingdom

[73] Assignee: Alfa Laval Separation AB, Tumba, Sweden

[21] Appl. No.: 08/974,760

[22] Filed: Nov. 20, 1997

Related U.S. Application Data

[63] Continuation of application No. 08/338,601, filed as application No. PCT/SE93/00437, May 18, 1993.

[30] Foreign Application Priority Data

May 19, 1992 [SE] Sweden ..... 9210624

[51] Int. Cl.[6] ..... B07B 1/34

[52] U.S. Cl. ..... 209/326; 209/329; 209/341; 209/366.5; 209/367

[58] Field of Search ..... 209/366.5, 367, 209/268, 269, 315, 325, 326, 327, 329, 331, 332, 333, 341; 74/87

[56] References Cited

U.S. PATENT DOCUMENTS

| | | | |
|---|---|---|---|
| 2,200,724 | 5/1940 | Robins . | |
| 4,236,417 | 12/1980 | Riedl | 209/366.5 X |
| 4,826,017 | 5/1989 | Du Bourg et al. | 209/269 X |

FOREIGN PATENT DOCUMENTS

| | | | |
|---|---|---|---|
| 0025408 | 3/1981 | European Pat. Off. . | |
| 2732892 | 1/1979 | Germany | 209/366.5 |
| 445090 | 6/1986 | Sweden . | |
| 2034437 | 6/1980 | United Kingdom | 209/366.5 |
| 2224455 | 5/1990 | United Kingdom . | |

*Primary Examiner*—David H. Bollinger
*Attorney, Agent, or Firm*—Fish & Richardson P.C.

[57] ABSTRACT

A vibratory screening apparatus has two vibrator motors (19, 20, 19', 20') having respective out-of-balance weights arranged to produce substantially linear vibratory movement when, in use, these motors (19, 20, 19', 20') are running in mutually opposite directions, an electrical control means (37) connected to the motors (19, 20, 19', 20') and is selectively operable between a non-running mode in which both motors (19, 20) (19', 20') are stopped and two running modes in one of which both vibrator motors (19, 20, 19,' 20') run in mutually opposite directions to produce substantially linear vibratory movement and in the other of which at least one of the motors (19, 20, 19', 20') is rotationally reversed and both motors (19, 20, 19', 20') run to produce orbital vibratory movement. In a preferred arrangement, the out-of-balance weights (39, 42) in at least one (20) of the vibrator motors (19, 20) are adapted so that in one of the running modes the respective out-of-balance forces are mutually substantially equal, and in the other of the running modes the out-of-balance forces are mutually unequal. Alternatively, there is provided coupling means (47, 48), (49) for imposing rotational synchronization of the vibrator motors (19', 20') as required.

9 Claims, 6 Drawing Sheets

VIBRATORY SCREENING APPARATUS

This is a continuation of application Ser. No. 08/338,601, filed May 2, 1995, now abandoned, which claims the priority of PCT/SE93/00437, filed May 18, 1993, which claims the priority of Swedish application Ser. No. 9210624.4, filed May 19, 1992.

FIELD OF THE INVENTION

This invention relates to vibratory screening apparatus suitable for use in screening drilling muds returned from a bore hole.

BACKGROUND OF THE INVENTION

Hitherto, in connection with the screening of drilling muds, vibratory screening apparatus generally was constructed to operate in a single vibratory mode with orbital (circular/elliptical) movement.

The expression "drilling mud" embraces a variety of substances; and the need for screening in this context relates to the separation, from returned mud, of various particles of differing sizes and compositions. This variety has led to the realisation that efficiency of screening drilling muds is related to, inter alia, choosing between orbital and linear vibratory movements. Therefore, there has emerged a demand for vibratory screening apparatus constructed to operate with linear movement.

Generally, it is accepted that out-of-balance vibrator motors provide the best practical and cost-effective means for producing vibratory motion. A single vibrator motor produces orbital movement which is circular or elliptical depending upon the relative positions of the motor and the centre of mass of the apparatus. Two vibrator motors appropriately arranged and rotating in mutually opposite directions produce linear movement. However, whereas two such vibrator motors will self-sychronise to produce linear movement when rotating oppositely, they will not do when rotating uni-directionally.

There is now a need for vibratory screening apparatus operable selectively to perform orbital and linear vibratory movements. One solution for such a selectively-operable or "dual motion" apparatus might be to isolate (switch off) either one of the vibrator motors in a two-motor arrangement, thus converting from linear movement to orbital movement. De-isolating (switching on) the said one vibrator motor would accomplish reversion to linear motion. However, this solution would have the disadvantage that one vibrator motor would be idle during orbital movement and this undesirably would introduce a significant power-rating differential between the respective modes of operation.

SUMMARY OF THE INVENTION

According to the present invention, there is provided vibratory screening apparatus comprising two vibrator motors having respective out-of-balance weights arranged to produce substantially linear vibratory movement when, in use, these motors are running in mutually opposite directions, and electrical control means connected to the motors for starting and stopping the motors; wherein the electrical control means is selectively operable between a non-running mode in which both motors are stopped and two running modes in one of which both vibrator motors run in mutually opposite directions to produce substantially linear vibratory movement and in the other of which at least one of the motors is rotationally reversed and both motors run to produce orbital vibratory movement.

BRIEF DESCRIPTION OF THE DRAWINGS

Embodiments of the present invention will now be described, by way of example, with reference to the accompanying drawings in which:

FIG. 3 being a section on the line III—III in FIG. 4;

DETAILED DESCRIPTION

Figure 1:
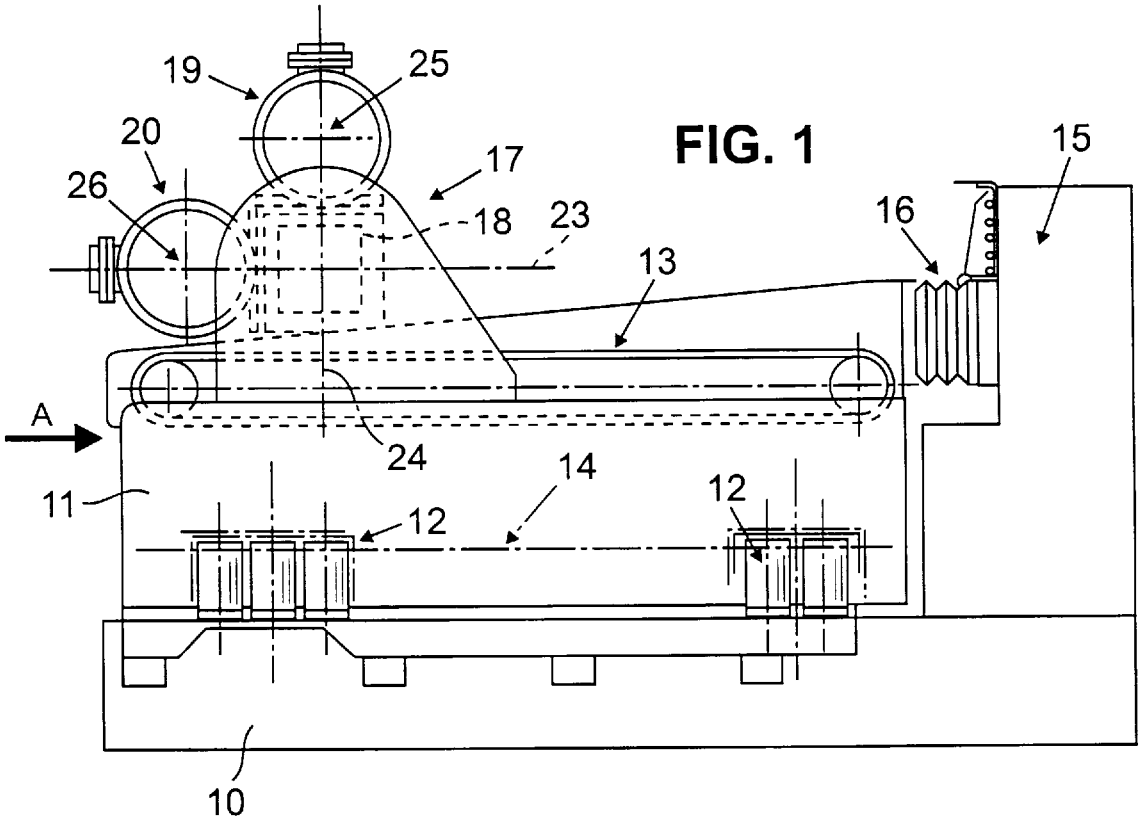
FIG. 1 is a side elevation of vibratory screening apparatus in accordance with the present invention.
Figure 2:
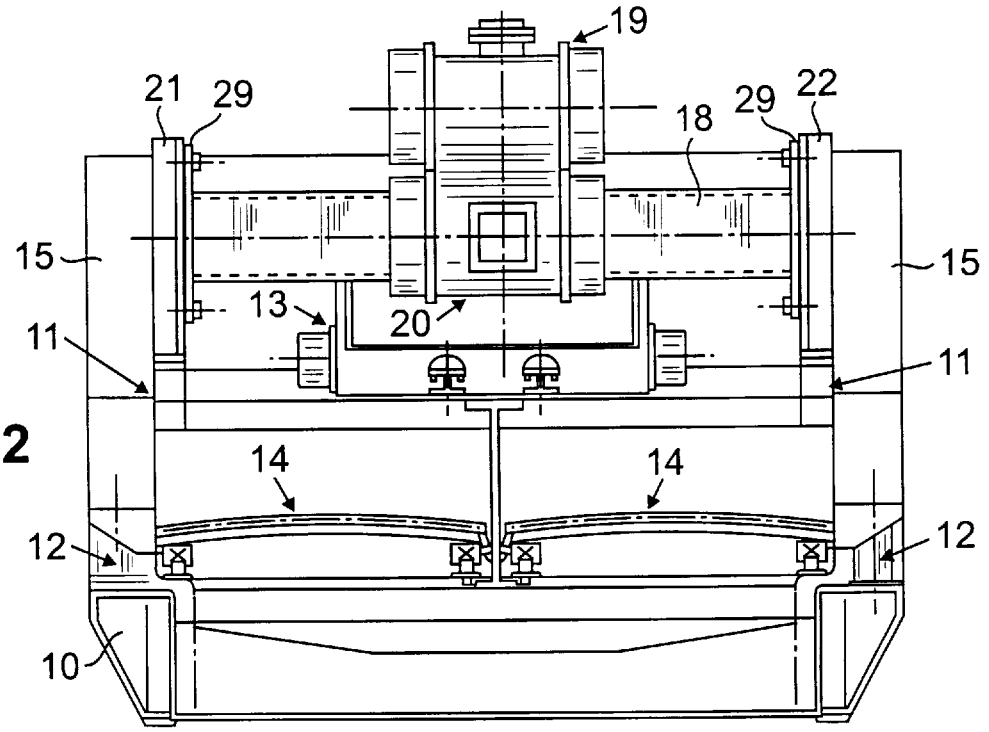
FIG. 2 is an end elevation in the direction of arrow A in FIG. 1.

In FIGS. 1 and 2 of the drawings, vibratory screening apparatus, simply known as a "shaker", consists of a base 10 on which is mounted a shaker basket 11 by means of flexible suspension elements 12. The basket 11 carries upper and lower screen assemblies 13, 14 which are supplied with material to be screened from a tank 15 which is mounted firmly on the base 10 and which communicates with the screen assemblies 13, 14 by way of a flexible connecting duct 16. The basket 11 carries a vibrator head assembly 17 which consists principally of a rigid cross-beam 18 which carries two vibrator motors 19, 20 and which is secured at each end to respective side cheeks 21, 22 of the vibratory head assembly 17. The side cheeks 21, 22 are firmly fixed to the basket 11. The cross-beam 18 is a hollow rolled steel section of square cross-sectional configuration and the principal axes of inertia of the cross-beam 18 are indicated by the reference numerals 23 and 24. The rotational axes of the motors 19, 20 are indicated by reference numerals 25, 26 respectively.

Figure 3:
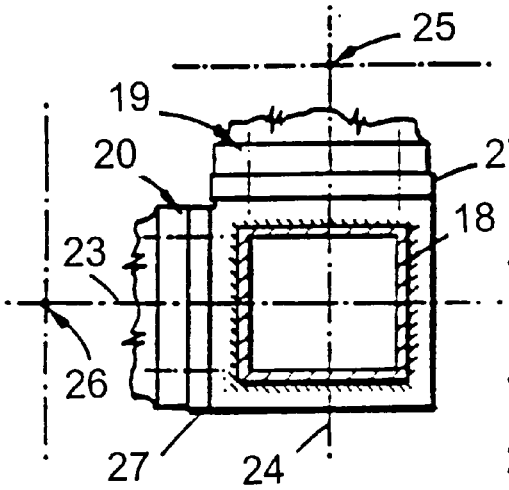
FIGS. 3 and 4 are respectively cross-sectional and elevational views of part of a cross-beam in FIGS. 1 and 2
Figure 4:
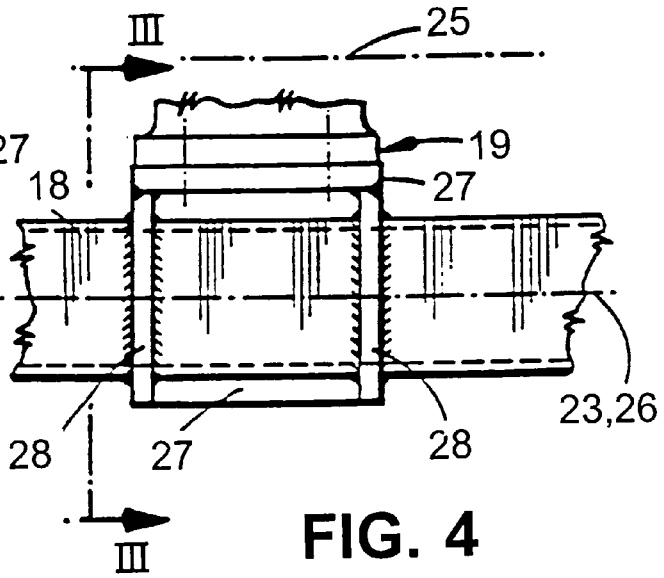

The motors 19, 20 are arranged respectively on mutually adjacent faces of the cross-beam 18 centrally of the cross-beam as shown in FIG. 2 and with the rotational axis of each motor lying substantially on one or other of the principal axes of inertia 23, 24. As is shown more clearly in FIGS. 3 and 4, the motors 19, 20 are secured to respective bridge plates 27 which themselves are welded to support flanges 28 each of which is welded to the cross-beam 18. These arrangements for mounting of the vibrator motors 19, 20 have been found to be capable of transmitting satisfactorily each of the different vibrational modes described herebelow.

Figure 5:
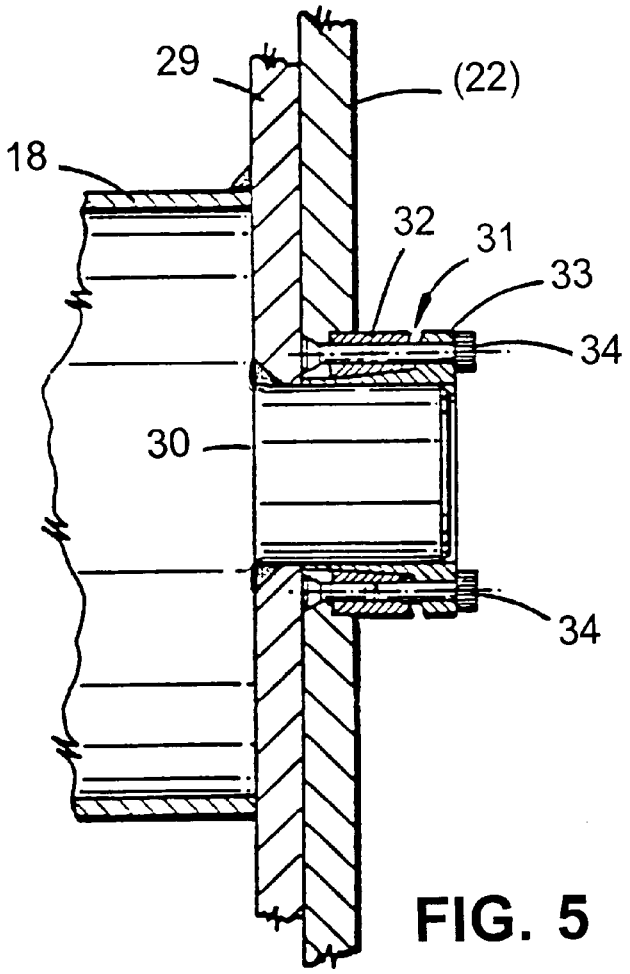
FIG. 5 is a cross-sectional view detailing the construction of one end of the cross-beat in FIGS. 1 and 2, and to a larger scale.

The cross-beam 18 is mounted to the side cheeks 21, 22 by means of flanges 29 which are welded to the ends of the cross-beam 18. The flanges 29 are bolted to the side cheeks 21, 22 as can be seen in FIG. 2 and the bolted connections effectively transmit at least some of the vibratory movements generated by the vibrator motors 19, 20. However, the flanges 29 are additionally coupled with the side cheeks 21, 22 by way of stub shafts 30 each of which is welded to a flange 29 and each of which extends into a tapered compression coupling assembly 31 as shown in FIG. 5. The stub shafts 30 are arranged on the central longitudinal axis of the cross-beam 18. Each coupling 31 has an outer member 32 securely fitted to one of the side cheeks 21, 22 and an inner member 33 in the form of a collet which can be urged into tight locking engagement with its stub shaft 30 by means of screws 34. In addition to the transmission of vibratory movements into the side cheeks 21, 22, the stub shafts 30 conveniently support the cross-beam 18 in the event of making angular position adjustments thereof about the longitudinal axis of the cross-beam. Such adjustments may be required in order to "fine-tune" the vibratory performance of the screening apparatus.

Figure 6:
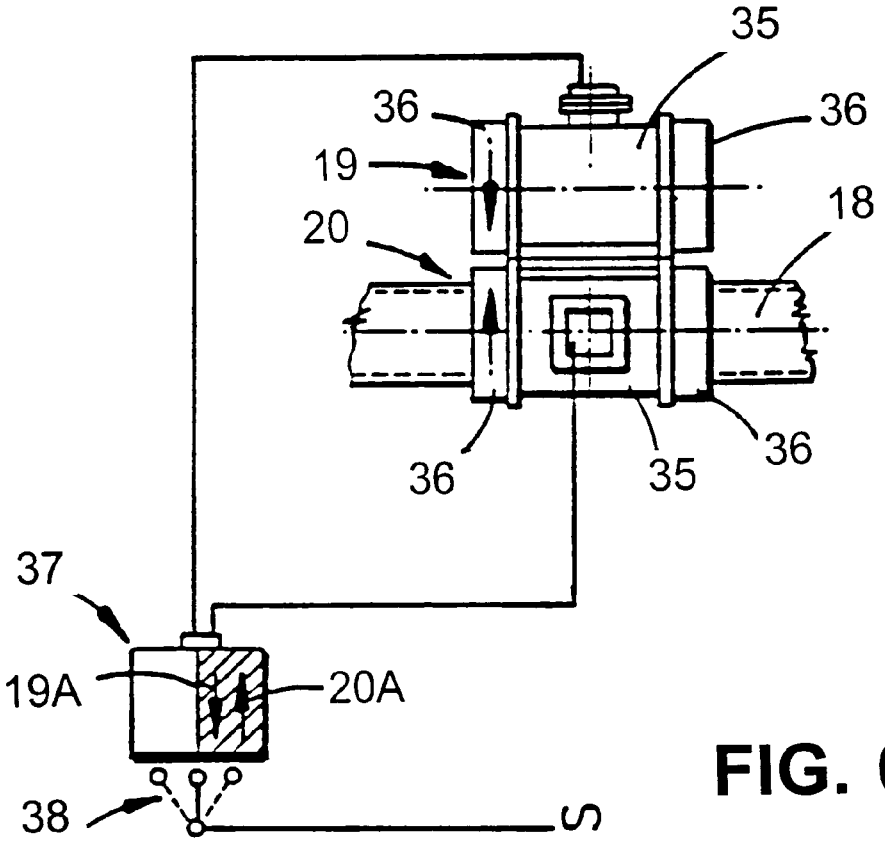
FIGS. 6 and 7 are partly diagrammatic elevations of part of FIG. 2 concerning vibrator motors.
Figure 7:
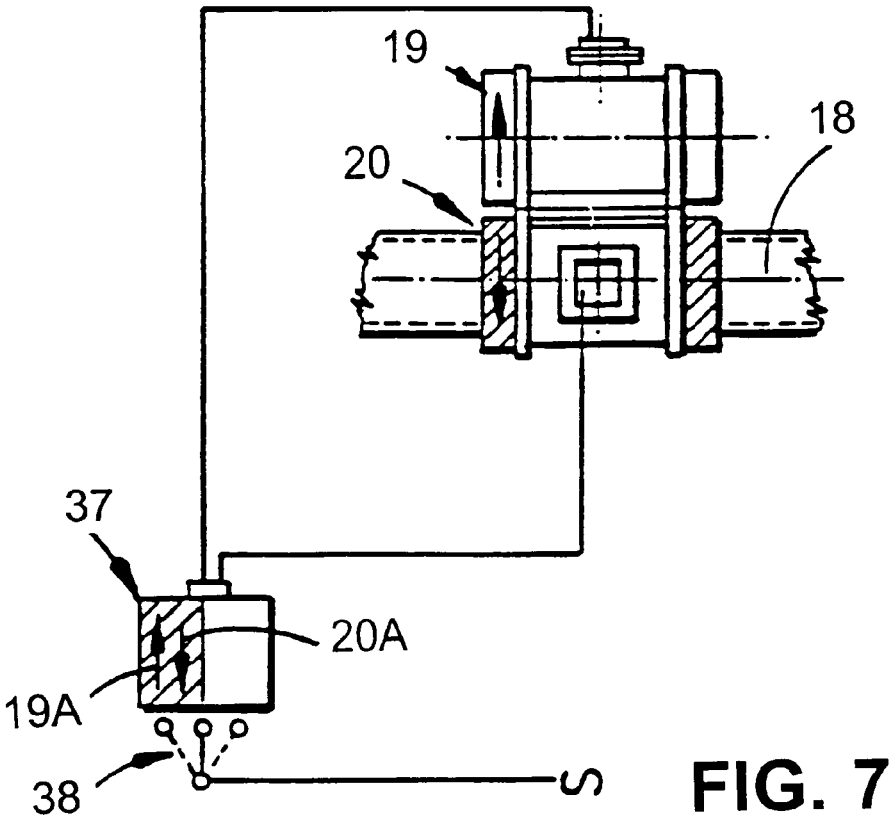

Each of the vibrator motors 19, 20 consists of an electric motor within a motor housing 35 and out-of-balance weights within weight housings 36 located at opposite ends of the motor housing 35. In FIGS. 6 and 7, the electric motors within the motor housings 35 are rotatable in either direction of rotation under the control of electrical control means in the form of reversing switchgear 37 in which respectively opposite directional conditions are represented by blank and shaded portions. In each switchgear 37, the active condition is represented by the shaded portion; and the directions of rotation of the vibrator motors 19, 20 are indicated by arrows 19A and 20A. The switchgear 37 is capable of stopping the motors 19, 20 as is indicated diagrammatically by the full-line switch position at 38.

Figure 8:
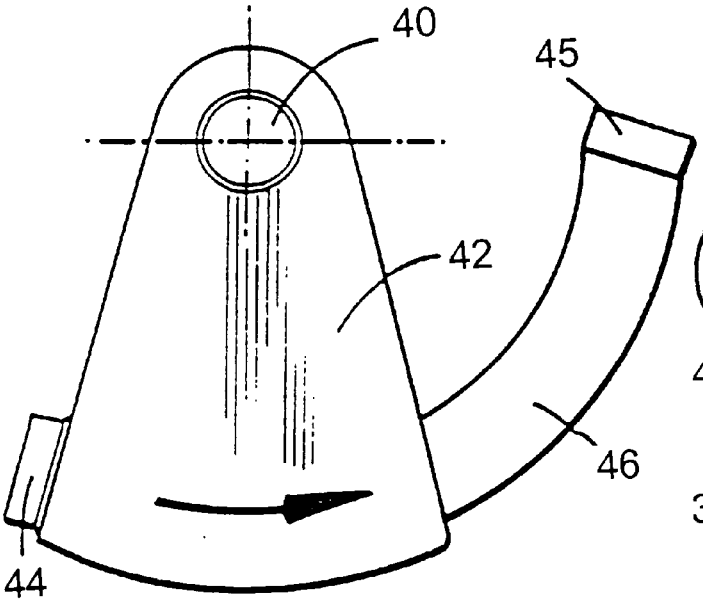
FIGS. 8, 9 and 10 are views showing the construction and operation of a self-adjustable out-of-balance weight incorporated in one of the vibrator motors of FIGS. 6 and 7 and to a larger scale.
Figure 9:
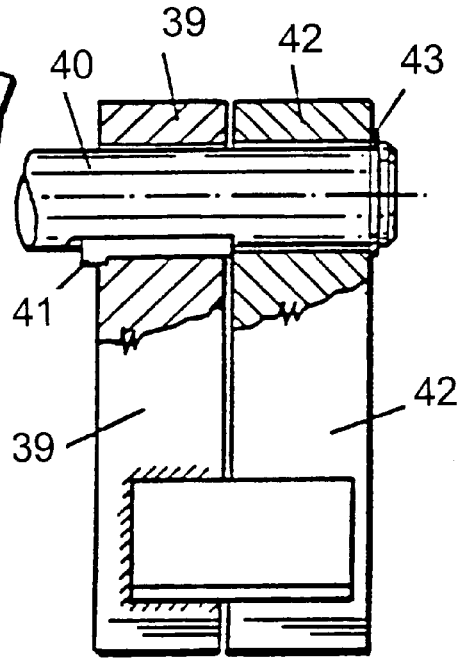
Figure 10:
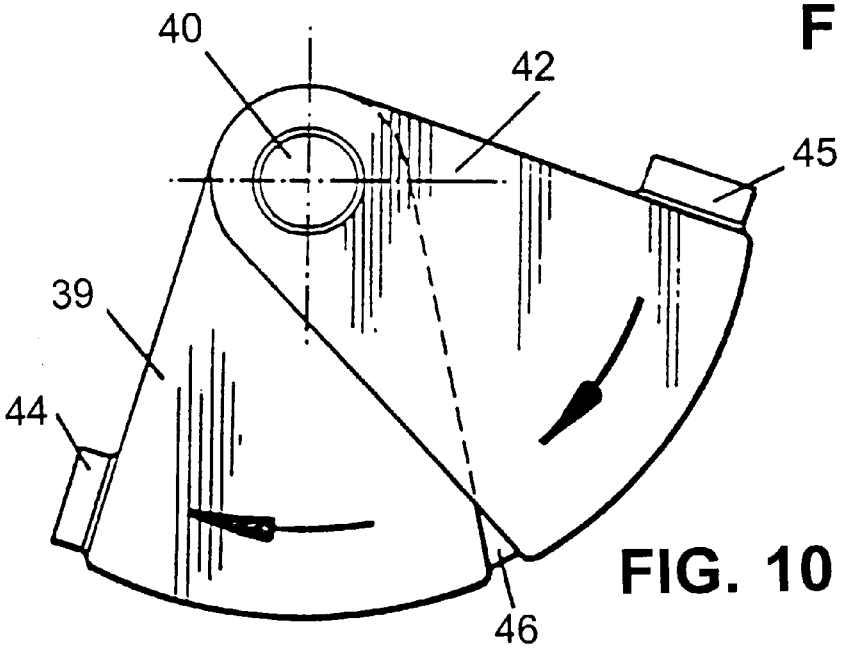

In the embodiment of FIGS. 6 and 7, the vibrator motor 20 is different from the vibrator motor 19 in that the out-of-balance weights incorporated in the vibrator motor 20 are self-adjustable according to the construction illustrated in FIGS. 8, 9 and 10. In these figures, the out-of-balance weight at each end of the vibrator motor shaft consists of a first weight 39 which is driven by the motor shaft 40 by means of a key 41, and a second weight 42 which is free on the shaft 40 and retained by a circlip 43. The driven weight 39 is associated with two angularly spaced stops 44, 45 for driving the weight 42. The stop 44 is attached directly to the driven weight 39, and the stop 45 is carried by an arcuate member 46 which is attached to the weight 39. Thus, when the shaft 40 (as seen in FIG. 8) rotates counter-clockwise, the stop 44 drives the weight 42 with the latter in registration with the weight 39 providing a relatively high out-of-balance weight value. With the shaft 40 rotating clockwise (as seen in FIG. 10), the alternative stop 45 drives the weight 42 with the latter displaced from registration with the weight 39 providing a relatively lower out-of-balance weight value. Referring now to FIGS. 6 and 7, in a first running mode (FIG. 6) to produce linear vibratory motion, the switchgear 37 runs the vibrator motors 19, 20 in opposite directions and with the effective out-of-balance weight value for the motor 20 equal to that of the motor 19. In a second running mode (FIG. 7) to produce orbital vibratory motion, the switchgear 37 reverses the directions of rotation of both vibrator motors 19, 20 so that these motors again run in opposite directions, but this time with the automatic adjustment of the out-of-balance weights in motor 20. In this condition, the vibrator motors 19, 20 are no longer equal in terms of out-of-balance masses with the result that orbital vibratory motion is produced.

Figure 11:
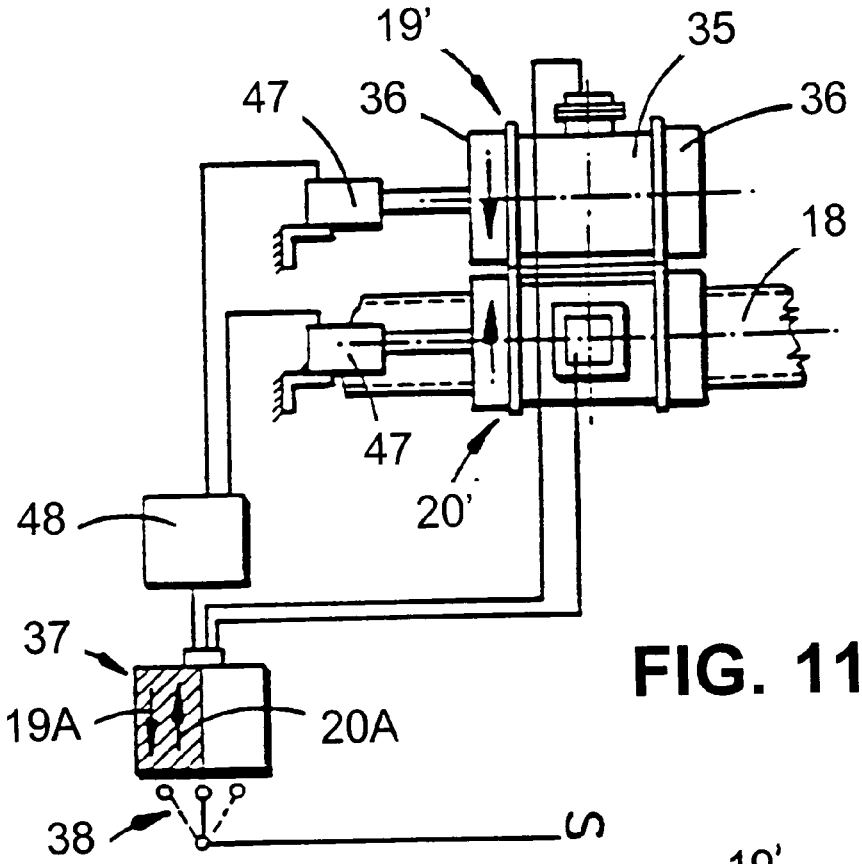
FIGS. 11 and 12 are partly diagrammatic elevations of part of FIG. 2 concerning vibrator motors, and showing a different embodiment of the invention.
Figure 12:
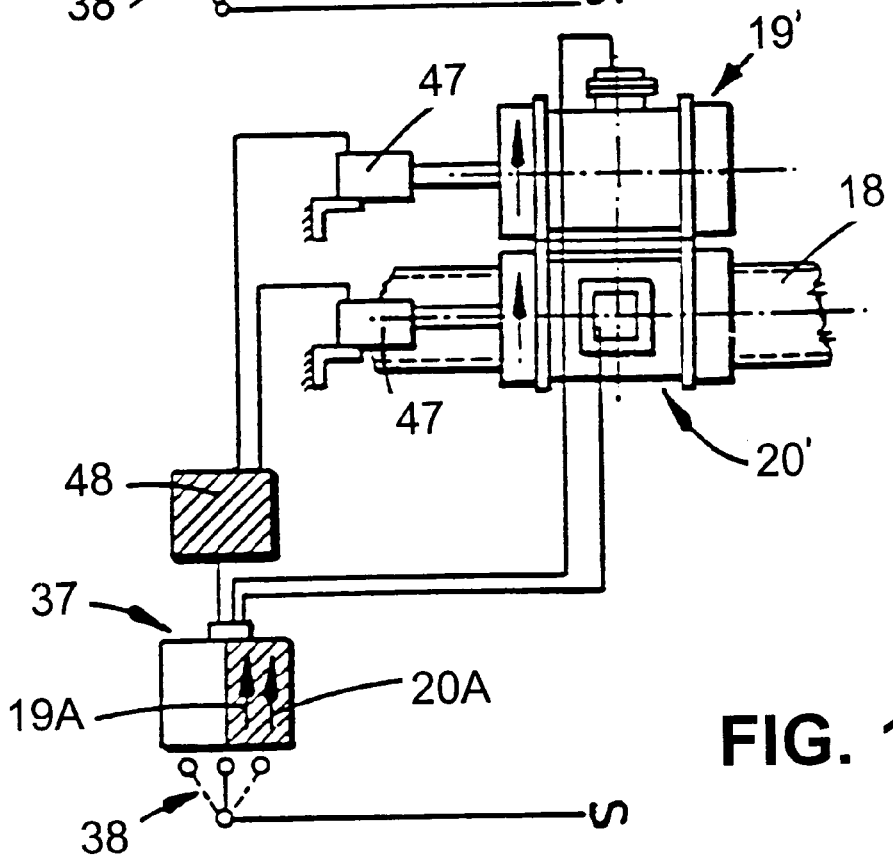

In FIGS. 11 and 12, parts corresponding with those in FIGS. 6 and 7 are given the reference numerals used in these figures; and the same diagrammatic representations are used. In FIGS. 11 and 12, vibrator motors 19', 20' are mounted on the cross-beam 18 in the same manner as shown in FIGS. 1 to 4. The vibrator motors 19', 20' are mutually identical. The shafts of the vibrator motors 19', 20' are extended to project beyond one of the weight housings 36 and these shafts are mechanically coupled with respective rotary encoders 47 which provide data in the form of electrical signals as to the angular positions of the shafts of the vibrator motors 19', 20'. The encoders 47 have outputs connected to an extension of the switchgear 37 in the form of data processing means 48 which can be set to run the vibrator motors 19', 20' angularly synchronised within close limits. Thus, the encoders 47 together with the data processing means 48 constitute a form of coupling means which can be activated to impose rotational synchronisation of the vibrator motors. In a first running mode (FIG. 11) to produce linear vibratory motion, the switchgear 37 runs the vibrator motors 19', 20' in opposite directions of rotation and the data processing means 48 is inactive. In this condition, the operation corresponds with that of FIG. 6. In a second running mode (FIG. 12) for producing orbital vibratory motion, the switchgear 37 runs the vibrator motors 19', 20' uni-directionally; and the data processing means 48 is now activated to use data from the encoders 47 to impose angular synchronisation of the motors 19', 20'. In a modification of the embodiment of FIGS. 11 and 12, the switchgear 37 and the data processing means 48 are used to impose angular synchronisation of the motors 19', 20' in both running modes.

Figure 13:
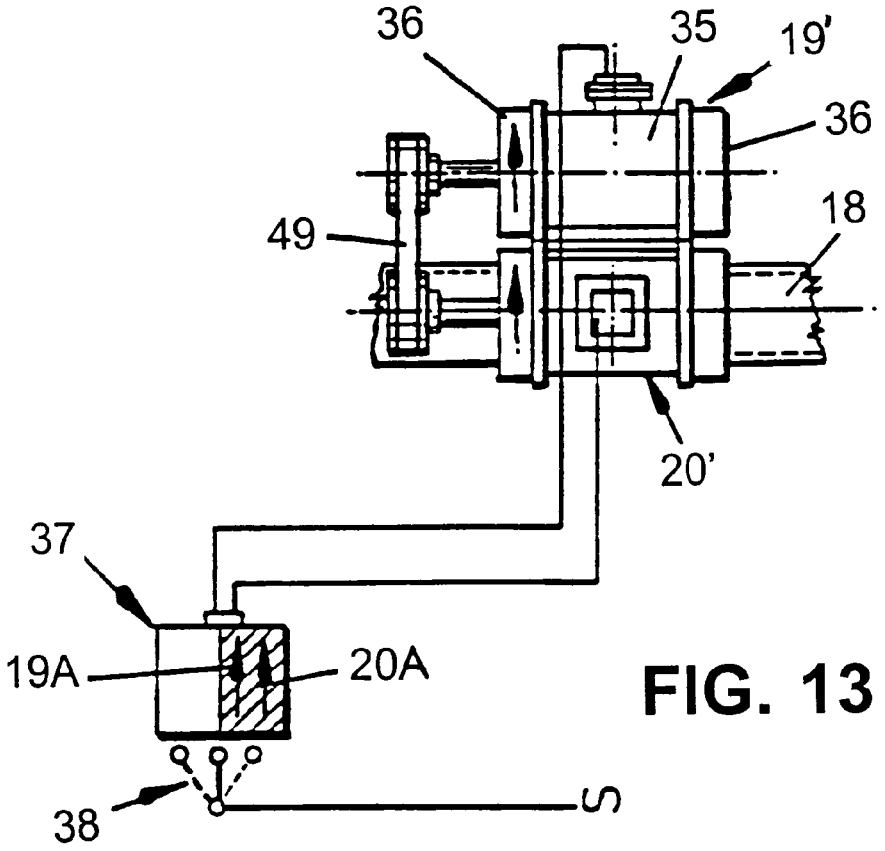
FIGS. 13 and 14 are partly diagrammatic elevations of part of FIG. 2 concerning vibrator motors, and showing a further embodiment of the present invention.
Figure 14:
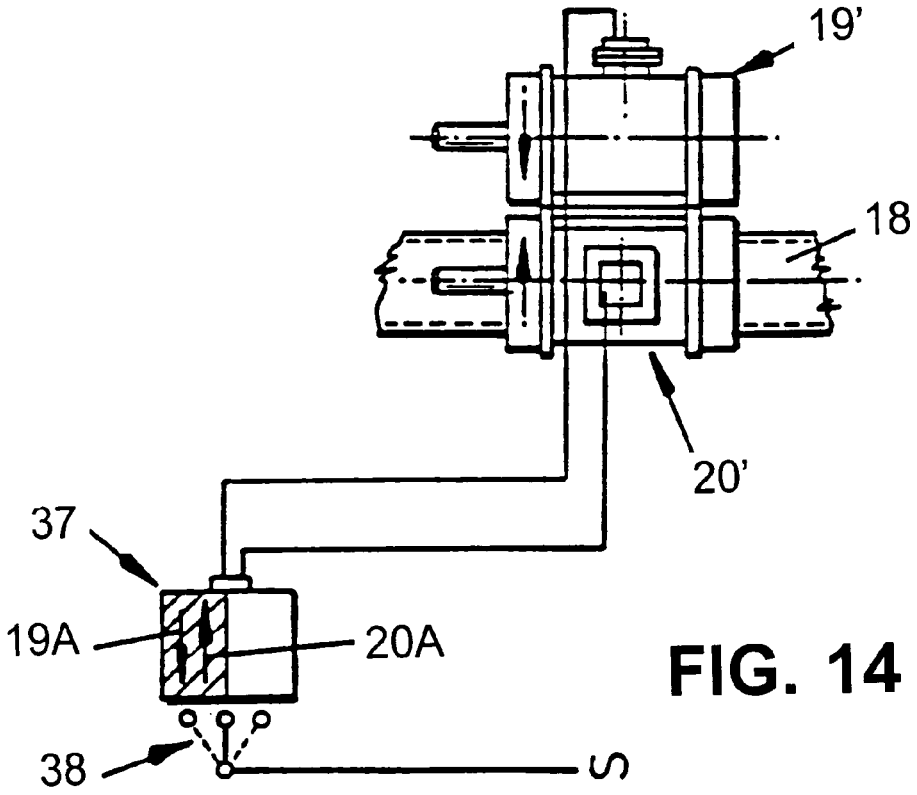

In FIGS. 13 and 14, parts corresponding with those in FIGS. 11 and 12 are given the same reference numerals as are used in in FIGS. 11 and 12; and the vibrator motors 19', 20' are mounted on the cross-beam 18 in the same manner as is described for FIGS. 1 to 4. In FIGS. 13 and 14, the shafts of the vibrator motors 19', 20' are provided with removable or releasable coupling means in the form of a positive or non-slip drive 49. In FIG. 13, the drive 49 is illustrated diagrammatically as a belt drive. However, it will be understood that the drive 49 may be chosen from a variety of known drives including the use of gears and/or clutches. In a first running mode (FIG. 13) to produce orbital vibratory motion, the control means 37 runs the motors 19', 20' uni-directionally and these motors are constrained to remain angularly sychronised by means of the drive 49. In a second running mode (FIG. 14) to produce linear vibratory motion, the control means 37 runs the motors 19', 20' in opposite directions of rotation with the drive 49 removed or disabled. In this condition, the motors 19', 20' self-sychronise in known manner.

What is claimed is:

1. Vibratory screening apparatus comprising a substantially horizontal screen, two vibrator motors adapted to vibrate the screen in a feeding direction for material maintained on the screen and electrical control means connected to the motors, said motors having respective rotatable shafts, each of which forms an angle with said feeding direction and is disposed in non-alignment with the other rotatable shaft, so that the two shafts may be rotated in mutually opposite directions, out-of-balance weights being mounted on said shafts and adapted to provide substantially equal out-of-balance forces from the two motors when said shafts are rotated in said mutually opposite directions, wherein said electrical control means is selectively operable between two running modes for the motors, in one of which modes the shafts of the motors rotate in said mutually opposite directions, producing a linear vibratory movement of the screen in said feeding direction, and in the other one of which modes the shaft of one of the motors is rotationally reversed, so that the two motor shafts rotate uni-directionally, causing orbital vibratory movement of the screen in said feeding direction.

2. The vibratory screening apparatus according to claim 1, wherein the two vibrator motors are mounted on a horizontal cross-beam of the vibratory apparatus with their shafts normal to said feeding direction, the cross-beam having a rectangular or square hollow cross-section, and further wherein the vibrator motors are arranged respectively on mutually adjacent faces of the cross-beam.

3. The vibratory screening apparatus according to claim 2, wherein as viewed in cross-sectional elevation the rotational axis of each vibrator motor lies substantially on one or other of the principal axes of inertia of the cross-beam.

4. The vibratory screening apparatus according to claim 1, wherein the vibrator motors are arranged with their shafts normal to said feeding direction.

5. The vibratory screening apparatus according to claim 1, wherein the vibrator motors are arranged with their shafts mutually parallel.

6. The vibratory screening apparatus according to claim 1, wherein the vibrator motors are arranged with their shafts substantially horizontal.

7. Vibratory screening apparatus comprising a substantially horizontal screen, two vibrator motors adapted to vibrate the screen in a feeding direction for material maintained on the screen and electrical control means connected to the motors, said motors having respective rotatable shafts, each of which forms an angle with said feeding direction and is disposed in non-alignment with the other rotable shaft, so that the two shafts may be rotated in mutually opposite directions, out-of-balance weights being mounted on said shafts and adapted to provide substantially equal out-of-balance forces from the two motors when said shafts are rotated in said mutually opposite directions, wherein said electrical control means is selectively operable between two running modes for the motors, in one of which modes the shafts of the motors rotate in said mutually opposite directions, producing a linear vibratory movement of the screen in said feeding direction, and in the other one of which modes the shafts of both the motors are rotationally reversed to cause orbital vibratory movement of the screen in said feeding direction, the shaft of one of the motors carrying a first weight fixed rotationally with respect to the shaft and a second weight free on the shaft and engageable by angularly spaced stops disposed for driving said second weight with a first angular relationship with the first weight in one direction of rotation and with a different angular relationship with the first weight in the opposite direction of rotation.

8. The vibratory screening apparatus according to claim 7, wherein coupling means is provided for imposing synchronization of the vibratory motors in said other running mode, said coupling means being removable or releasable to permit self-synchronization of the vibratory motors in said one running mode.

9. The vibratory screening apparatus according to claim 8, wherein said coupling means comprises a removable or disengageable mechanical drive connected to said shafts.

* * * * *